United States Patent [19]

Whiteman, Jr.

[11] Patent Number: 4,673,311

[45] Date of Patent: Jun. 16, 1987

[54] CONCRETE FINISHING MACHINE HAVING COUNTERBALANCED BLADE PITCH ADJUSTMENT APPARATUS

[76] Inventor: Marvin E. Whiteman, Jr., 2254 Braniff St., Boise, Id. 83706

[21] Appl. No.: 751,606

[22] Filed: Jul. 2, 1985

[51] Int. Cl.[4] ..... E01C 19/22

[52] U.S. Cl. ..... 404/112; 74/491; 74/592; 74/89.15; 74/479

[58] Field of Search ..... 425/458, 456; 404/112, 404/97; 74/491, 592, 89.15, 479; 172/424, 506

[56] References Cited

U.S. PATENT DOCUMENTS

| | | | |
|---|---|---|---|
| 752,884 | 2/1904 | Carmichael | 74/592 |
| 1,089,948 | 3/1914 | Nohr | 172/424 |
| 1,150,871 | 8/1915 | Mainwaring | 74/592 |
| 1,422,350 | 7/1922 | Emerson | 172/506 |
| 2,230,850 | 2/1941 | Sommerfeld | 174/424 |
| 2,342,702 | 4/1944 | Noble | 172/424 |
| 2,375,026 | 5/1945 | Mott | 172/506 |
| 2,468,981 | 5/1949 | Huffman | 404/112 |
| 2,581,512 | 1/1952 | Baldwin | 172/424 |
| 2,621,568 | 12/1952 | Fletcher | 404/112 |
| 2,789,875 | 4/1957 | Van Ordt | 74/592 |
| 2,887,934 | 5/1959 | Whiteman | 404/112 |
| 2,979,996 | 4/1961 | Spitler et al. | 404/112 |
| 2,989,334 | 6/1961 | Browne | 74/491 |
| 3,412,657 | 11/1968 | Colizza et al. | 404/112 |
| 4,320,986 | 3/1982 | Morrison | 404/112 |

FOREIGN PATENT DOCUMENTS

| | | | |
|---|---|---|---|
| 867728 | 5/1961 | United Kingdom | 404/112 |

*Primary Examiner*—Tim Miles

*Attorney, Agent, or Firm*—Pretty, Schroeder, Brueggemann & Clark

[57] ABSTRACT

A concrete finishing machine having a rotatable trowel blade assembly and a mechanism for controllably adjusting the pitch of the trowel blades relative to a wet concrete surface on which the blades rest. Manual pivoting of a control lever controllably adjusts the trowel blade pitch and, in doing so, automatically increases or decreases the amount of blade surface contacting the concrete surface, and correspondingly lowers or raises the machine relative to the surface. The contacting blade surface supports the machine's entire weight. A special counterbalancing apparatus that includes, for example, a compressed coil spring, biases the control lever so as to compensate for the machine's weight and permits an operator to adjust the blade pitch with substantially less force than otherwise would be required.

25 Claims, 10 Drawing Figures

CONCRETE FINISHING MACHINE HAVING COUNTERBALANCED BLADE PITCH ADJUSTMENT APPARATUS

BACKGROUND OF THE INVENTION

This invention relates generally to concrete finishing machines, and, more particularly, to apparatus for controllably adjusting the pitch of the trowel blades of such machines.

Concrete finishing machines have been used for many years to level and finish large concrete pads. Such machines typically include a rotatable trowel blade assembly having a plurality (e.g., three or four) generally planar trowel blades mounted on trowel arms projecting radially outwardly from a common hub, all of which are rotated by a gasoline-powered engine. The trowel blades rest directly on the concrete surface to be finished and support the machine's entire weight.

Concrete finishing machines typically further include means for controllably pivoting the trowel blades about their respective radial axes, to change their pitch relative to the concrete surface to be finished. Changing the blades' pitch correspondingly changes the proportion of blade surface contacting the concrete surface, such that the machine's weight is supported by a larger or smaller area of the surface. In use, the machine makes several passes over the concrete surface as the concrete hardens, with the blade pitch being specially selected for each pass. In the initial pass, when the concrete is still very wet and plastic, the blade pitch is usually adjusted to be substantially parallel with the concrete surface, thereby lying flat upon it and spreading the machine's weight over a maximum surface area. In subsequent passes, as the concrete hardens and becomes less plastic, the blade pitch is progressively increased, with the pitch used in the final pass sometimes being as much as about 30 degrees.

Improvements in recent concrete formulations have made some concrete slabs include pockets or areas of varying plasticity. In such situations, it is necessary to rapidly adjust the trowel blade pitch in order to produce the desired finish. It is also necessary to adjust the trowel blade pitch when the machine is being moved to an adjacent area where the concrete is at a different stage of hardness. In this situation, which frequently occurs when very large concrete pads are being formed, the blade pitch must be adjusted very rapidly.

In the past, the pitch of the trowel blades was typically adjusted using a thrust collar that pushed downwardly on fingers projecting upwardly from the rear sides of the respective trowel arms. A downward force on the thrust collar is provided by a yoke that is pivotally secured to the machine's frame. A tension cable connects the end of the yoke opposite the pivot point with a screw handle located at the remote end of a machine handle used by the operator to guide and control the machine. Rotation of the screw handle adjusts the yoke's angle, to move the thrust collar up or down a corresponding amount and thereby provide the desired trowel blade pitch.

The trailing edge of each trowel blade, which contacts the concrete surface on which the machine rests, is spaced from the blade's pivot axis. Any change in blade pitch therefore transfers the machine's weight by raising or lowering the machine on the surface. Since the machine is generally quite heavy, usually weighing several hundred pounds, the screw handle used for blade pitch adjustment must have threads with a very small pitch to permit the operator to rotate it conveniently. Consequently, the blade pitch adjustment can be made only very slowly. This has proven to be unsatisfactory in many situations.

Some concrete finishing macines have overcome the slow pitch adjustment afforded by the screw handle described above by replacing the screw handle with a long lever attached to the machine's framework. Although this configuration permits a rapid adjustment of the blade pitch, it is not generally convenient to use. This is because the lever requires large movements for lever advantage and because the lever is not conveniently located on the machine handle itself and thus requires the operator to control the machine using merely one hand and unsteady footing.

It should be appreciated from the foregoing that there is a significant need for a concrete finishing machine having a trowel blade adjustment apparatus that can be used by the operator to rapidly adjust the trowel blade pitch, yet is simple in construction and convenient to use. The present invention fulfills this need.

SUMMARY OF THE INVENTION

The present invention is embodied in a concrete finishing machine having special adjustment means for conveniently and rapidly adjusting the pitch of the machine's trowel blades. The adjustment means includes control handle means along with a means for interconnecting the control handle means with the machine's trowel blade assembly. Movement of the control handle means is coupled via the interconnecting means to the blade assembly, to effect a corresponding pivoting adjustment of the individual trowel blades. In accordance with the invention, the adjustment means further includes counterbalancing means located within a tubular machine handle and operatively connected to the control handle means, for applying a counterbalancing force comparable to the force applied to the control handle means by the interconnecting means. The position of the control handle means can thereby be conveniently adjusted with substantially less force than otherwise would be required.

More particularly, the concrete finishing machine of the invention includes a rotatable trowel blade assembly having a plurality (e.g., three or four) of substantially planar trowel blades secured to arms projecting radially outwardly from a central hub that is rotatably driven by a suitable motor. The blades are adapted to rest on a concrete surface and support substantially the entire weight of the machine. The blades are all pivotable about their respective radial axes, to change their pitch relative to the concrete surface over a range extending from substantially 0 degrees to about 30 degrees. This pivoting changes the area of the blade surface contacting the concrete and thus changes the pressure applied to the concrete. The pivoting also raises or lowers the machine on the surface, correspondingly. The interconnecting means preferably includes a tension cable interconnecting the control handle means with the trowel blade assembly. The trowel blade assembly is configured such that the machine's weight is reflected in the tension of the tension cable.

In several embodiments of the invention, the control handle means takes the form of a lever pivotally secured near the end of the elongated, tubular machine handle. One end of the lever is manually engagable by a machine operator and can include means for releasably locking the lever in a selected pivotal position. The counterbalancing means and the tension cable engage the lever at selected locations spaced from both the lever's pivot point and the lever's manually-engageable end, to provide any desired lever advantage. Conveniently, the counterbalancing means and cable can engage the lever via a slide block and rod located within the tubular machine handle. In this fashion, any desired proportion (e.g., 80 percent) of the tension in the cable can be compensated for by the counterbalancing means, and the lever can be conveniently adjusted to the desired position, without the need for the operator to apply a significant force.

The counterbalancing means of the invention can take several convenient forms. In one embodiment, the counterbalancing means includes a coil spring located within the tubular machine handle, coaxial with the tension cable. The spring is preferably compressed. Alternatively, the coil spring can be housed in a separate tube secured to the machine handle.

In a more detailed aspect of the invention, the counterbalancing means includes means for controllably adjusting the amount by which it forcibly resists the force applied to the control handle means by the tension cable. In embodiments that include a compressed spring, this adjustment means can include means for selectively adjusting the amount by which the spring is nominally compressed or pre-loaded, to allow for subjective desires of the operator and for blades of differing sizes and purposes.

In another more detailed aspect of the invention, the means for releasably locking the control lever in a selected position can include a gear mounted on the machine handle and a spring-biased dog mounted on the lever. In addition, the gear can be circular and means can be included for rotating the gear relative to the handle such that, when the lever's dog is selectively engaged, rotation of the gear effects a corresponding pivoting of the lever and adjustment of the trowel blade pitch.

Other aspects and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
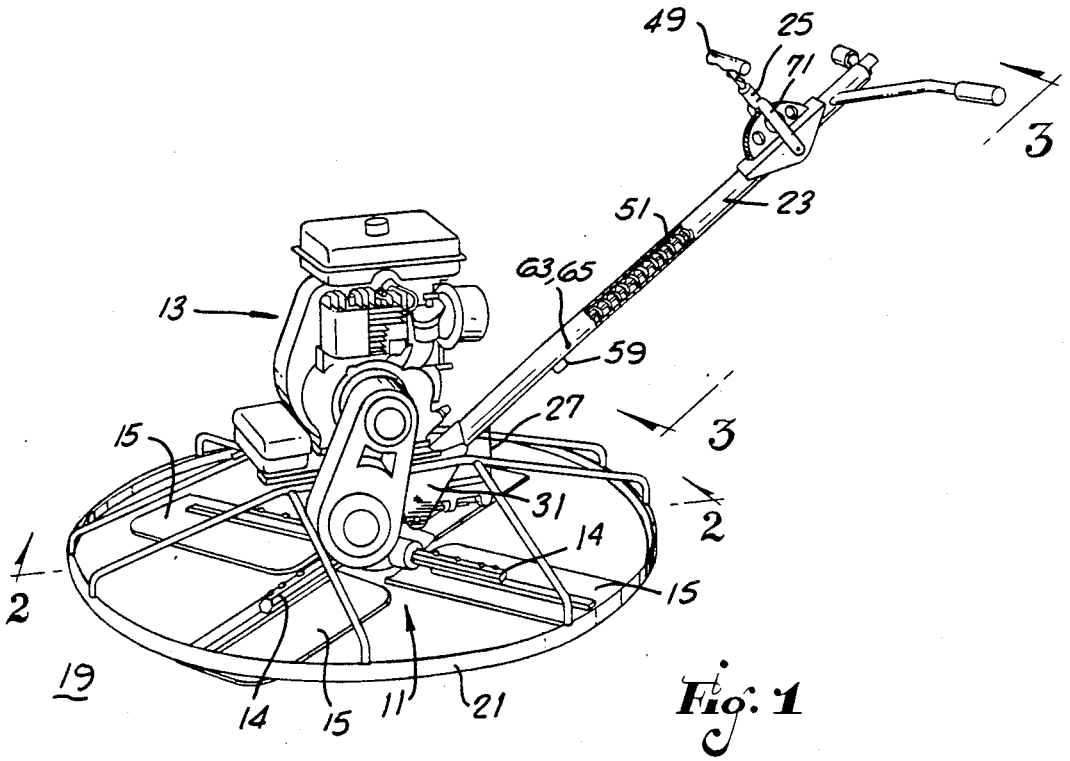
FIG. 1 is a perspective view of one embodiment of a concrete finishing machine constructed in accordance with the present invention.
Figure 2:
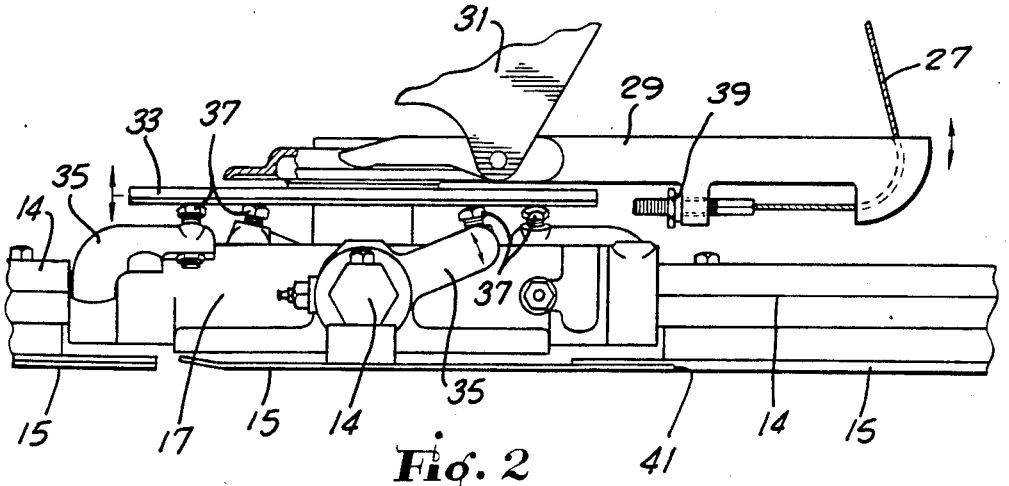
FIG. 2 is a fragmentary elevational view of the machine's trowel blade assembly, taken substantialy in the direction of the arrows 2—2 in FIG. 1, but with the trowel blade assembly rotated by about 45 degrees.

As shown in the accompanying drawings, for purposes of illustration, the present invention is embodied in a concrete finishing machine of the kind that includes a rotatable trowel blade assembly 11 rotatably driven by a suitable engine 13. With particular reference to FIGS. 1 and 2, the trowel blade assembly includes a plurality (e.g., three or four) of uniformly-spaced trowel blade arms 14 projecting radially outwardly from a common hub 17, each arm carrying a separate trowel blade 15. The blades rest directly on a wet, semi-plastic concrete surface 19 to be finished and support the machine's entire weight. For safety, a guard ring 21 encircles the peripheral tips of the trowel blades. An operator (not shown) can guide and control the machine using a tubular machine handle 23.

The pitch of the trowel blades 15 relative to the concrete surface 19 on which they rest can be manually adjusted using a control lever 25 pivotally secured to the tubular machine handle 23. This pitch adjustment is made according to the concrete's hardness or plasticity, beginning with the blades lying substantially flat on the surface when the concrete is very wet or plastic and ending with the blades at a substantial angle (e.g., 30 degrees) when the concrete has substantially hardened. The control lever is connected to the trowel blade assembly by a tension cable 27 extending through the tubular handle 23.

To transform movement of the tension cable 27 into pivoting of the individual trowel blades 15, the trowel blade assembly 11 includes a yoke 29 pivotally secured to the machine frame 31 along with an adjacent thrust collar 33 overlaying the blade hub 17. In addition, each trowel blade includes an outwardly-projecting arm 35 that can act as a crank for pivoting the blade about its radial axis. The head of an adjustment screw 37 projects upwardly from the end of the arm for engagement with the thrust collar The tension cable 27 is connected by a nut 39 to one end of the yoke 29, such that any movement of the cable effects a corresponding pivoting of the yoke. The end of the yoke opposite the cable connection bears downwardly on the thrust collar 33, which in turn bears downwardly on the screws 37 and crank arms 35 of four trowel blades 15. Thus, pivoting of the yoke effects a corresponding pivoting of the trowel blades about their respective radial axes.

FIGS. 1 and 2 depict the cable 27 to be adjusted (by means of the control lever 25) such that the trowel blades 15 are pivoted to a pitch angle of substantially 0 degrees. The blades therefore rest flat on the concrete surface 19. Pulling rearwardly on the control lever will force the thrust collar 33 downwardly and thereby increase the blade pitch such that the blades will all rest on their rear edges 41 (FIG. 2). Since these edges are spaced from the respective pivot axes, any change in blade pitch automatically raises or lowers the machine on the surface correspondingly. This decreases or increases the area of contact between the blades and the surface and correspondingly changes the weight concentration or applied pressure.

Figure 3:
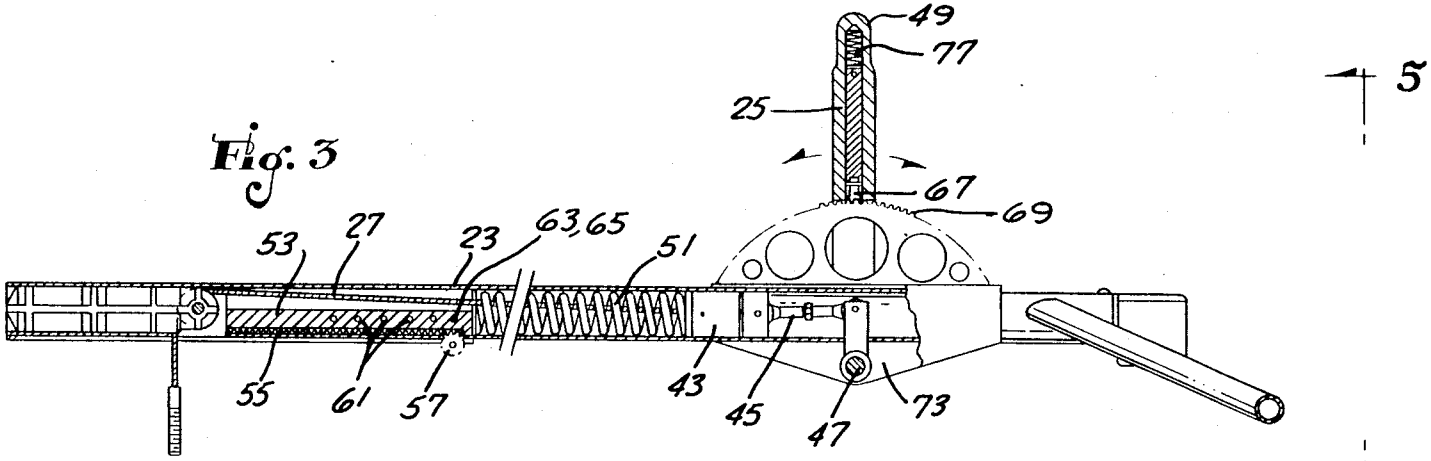
FIG. 3 is a side sectional view of the machine's handle, control lever, and counterbalancing spring, taken substantially in the direction of the arrows 3—3 in FIG. 1.

Because the concrete finishing machine is quite heavy, typically weighing several hundred pounds, and because this weight must be transferred (e.g., raised or lowered) when a pitch adjustment is made, a substantial force must be transmitted by the tension cable 27 to effect a pitch adjustment. A certain reduction in this required force is provided by a suitable connection of the tension cable to the control lever 25. In particular, and as shown in FIG. 3, the cable extends through the tubular handle 23 where it is attached to a slide block 43 that is, in turn, attached by a connecting rod 45 to a portion of the lever spaced very closely to the lever's pivot point 47. This is significantly closer to the pivot point than a handle 49 mounted on the end of the control lever and manually engagable by the operator, so a significant lever advantage is provided. Even considering this lever advantage, however, the force required to balance that of the tension cable is significantly greater than the operator, by himself, can conveniently apply.

In accordance with the invention, the concrete finishing machine embodiment of FIGS. 1–3 further includes a compressed coil spring 51 located within the tubular handle 23 and adapted to push against the slide block 43 that is coupled by the connecting rod 45 to the control lever 25. The force imparted by this coil spring, which is coaxial with the tension cable 27, is sized to be comparable with the force applied by the cable, thus substantially reducing its effect. As a result, the control lever can be moved to any selected pivotal position without the need for the operator applying any significant force.

The compressed coil spring 51 preferably extends throughout substantially the entire length of the tubular handle 23. Moving the control lever over its entire range of positions therefore changes the spring's length by only a small fraction. Consequently, the spring force remains substantially constant over the entire range of lever positions.

In a more detailed aspect of the invention, the bottom end of the coil spring 51 presses against an adjustable slide block 53 (FIG. 3) that can be selectively positioned so as to vary the amount by which the spring is nominally compressed. This is done to allow for the operator's subjective preference and for blades of differing sizes and purposes. The slide block includes a rack gear 55 on its underside, which is engaged by a rotatable pinion gear 57 mounted on the machine handle 23. Controlled rotation of the pinion gear using a coaxial bolt 59 (FIG. 1) slides the slide block axially in the tubular handle, to effect the spring compression adjustment. The slide block is held in a selected position by aligning one of a number of spaced holes 61 formed in the block with a pair of holes 63 formed in the tubular handle and by then inserting through those aligned holes a suitable locking screw 65. The spaced holes are preferably located such that the operator can selectively counterbalance about 70 to 100 percent of the machine's weight.

Figure 9:
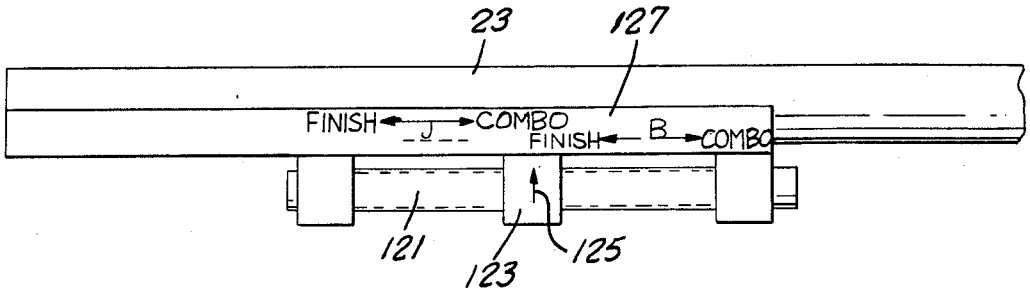
FIG. 9 is a fragmentary side elevational view of an alternative assembly for selectively pre-loading the counterbalancing spring located within the tubular machine handle.
Figure 10:
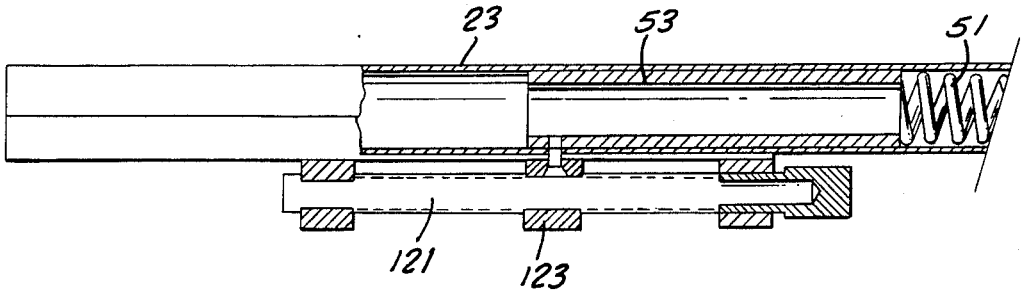
FIG. 10 is a side sectional view of the pre-loading assembly of FIG. 9.

An alternative mechanism for selectively pre-loading the compressed spring 51 is depicted in FIGS. 9 and 10. In this alternative mechanism, a lead screw 121 is rotatably mounted on the underside of the tubular machine handle 23, immediately beneath the slide block 53. A threaded follower 123 is secured to the slide block and thus slides the slide block axially within the machine handle in accordance with rotation of the lead screw. An indicator 125 secured to the threaded follower and a fixed marking plate 127 secured to the handle can be used as a guide in pre-loading the spring for the particular blades and weight conditions present.

Figure 5:
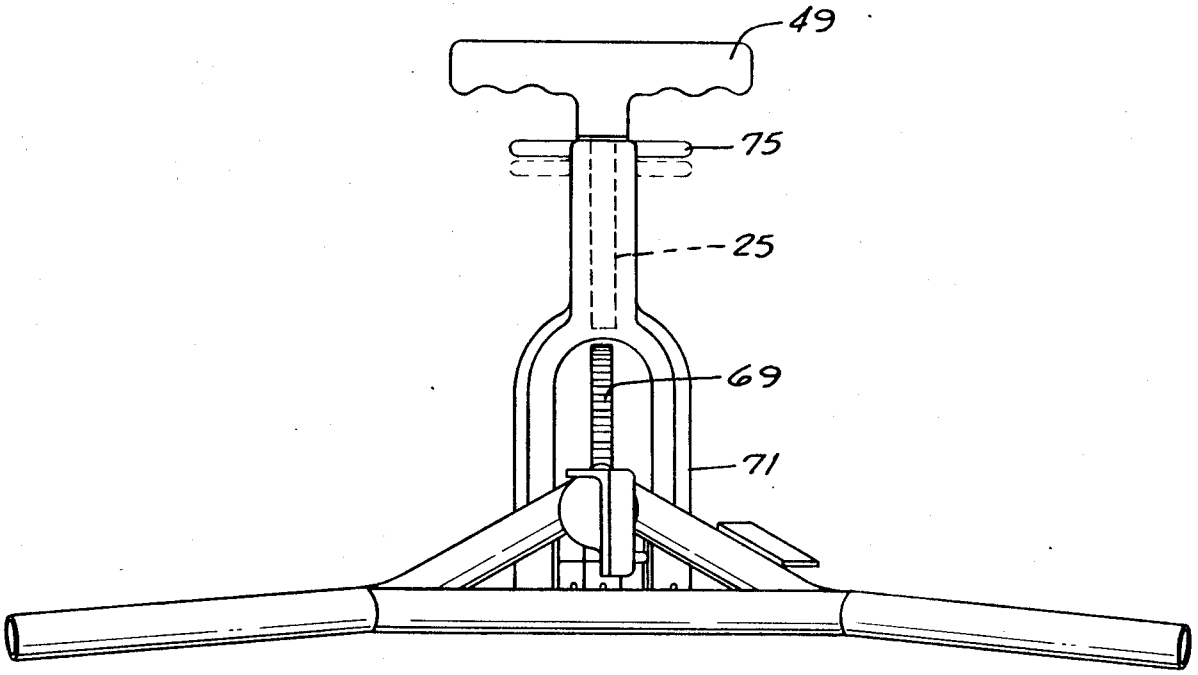
FIG. 5. is an axial view of the control handle and machine handle, taken substantially in the direction of the arrows 5—5 in FIG. 3.

As best shown in FIGS. 1, 3 and 5, the control lever 25 is held in its selected position by a spring-biased locking dog 67 and a mating locking gear 69. The dog is carried within the lever, and the locking gear is fixed to the machine handle 23. The lever includes a bottom U-shaped portion 71 that encircles the fixed locking gear 69 and that is pivotally secured by a suitable pin to a downwardly projecting flange 73 on the machine handle. The gear's central axis is aligned with the control lever's pivot point. The operator can pull upwardly on a transverse finger 75 to raise the dog away from the locking gear, against the resistance of a spring 77 located within the upper end of the lever. The lever can then be pivoted to any desired position and then release the finger to lock the lever in that position. This mechanism is very much similar to a releasable gear shift lever for an automobile's automatic transmission.

Figure 4:
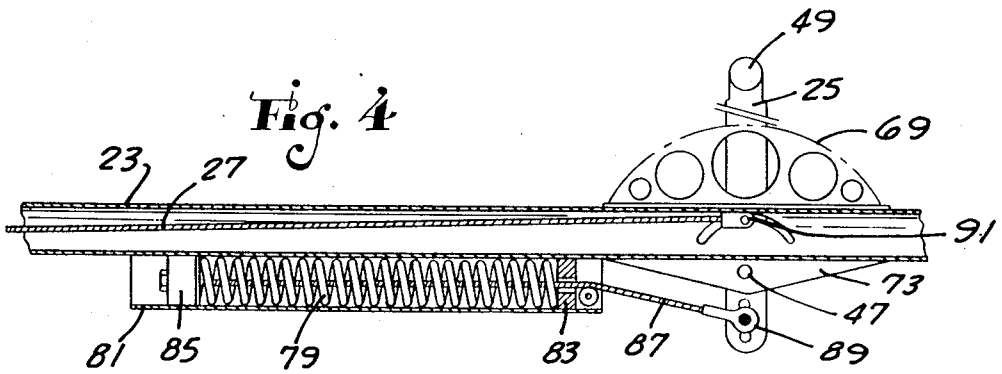
FIG. 4 is a fragmentary sectional view similar to FIG. 3, but of an alternative embodiment in which the counterbalancing spring is located in a separate tube carried by the machine's handle.

An alternative counterbalancing mechanism embodiment of the invention is depicted in FIG. 4. In this embodiment, a compressed coil spring 79 is located within a separate tube 81 carried on the underside of the tubular machine handle 23. The spring's upper end bears against a fixed block 83, while the spring's lower end bears against a movable block 85 that can slide axially within the tube 81. A second tension cable 87 interconnects the movable block with the control lever 25, at a connection 89 on the opposite side of the lever's pivot point 47 from the connection 91 of the first tension cable 27. The spring thereby counterbalances the force of the first tension cable.

The connection 89 of the second tension cable 87 to the control lever 25 can be selected from among a plurality (e.g., three) of possible points. Each such point is a different distance from the lever's pivot point 47, to permit selection of the desired proportion of the machine's weight that is counterbalanced.

Figure 6:
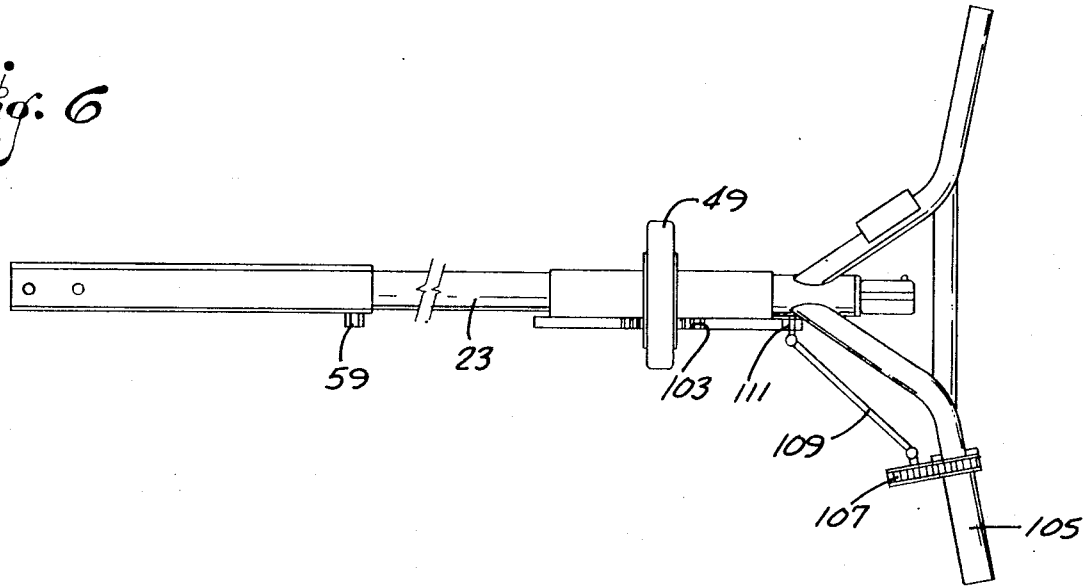
FIG. 6 is a top plan view of the handle portion of an alternative embodiment in which a locking gear is rotatable relative to the machine handle, to permit a fine adjustment of trowel blade pitch.
Figure 7:
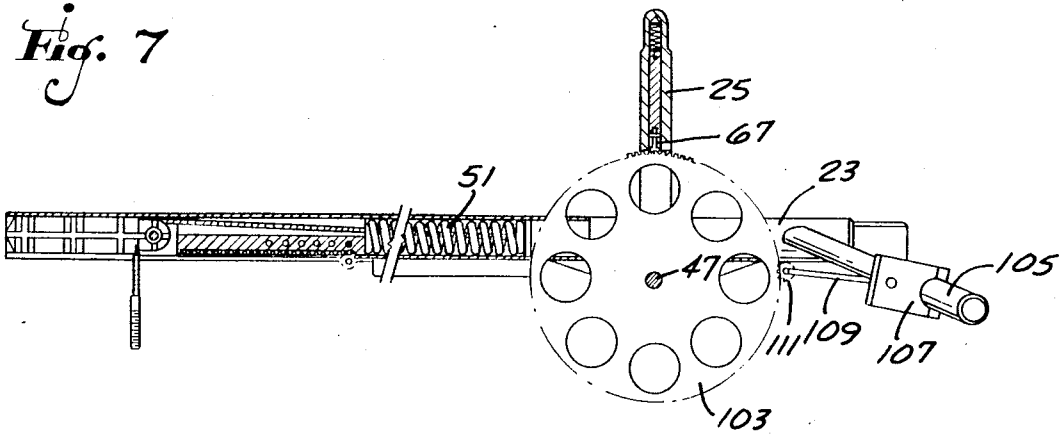
FIG. 7 is a side, partially sectional view of the handle portion of the machine embodiment of FIG. 7.

FIGS. 6 and 7 depict a modification applicable to all of the embodiments described above. In particular, this modification substitutes a rotatable gear 103 for the fixed locking gear 69. The rotatable gear is circular and rotatable about an axis coincident with the control lever's pivot axis 47. Rotation of the gear is effected manually using a rotatable handle grip 105 located on the machine handle 23. A reduction gear assembly 107, universal joint linkage 109, and pinion gear 111 interconnect the handle grip with the rotatable gear. Thus, when the control lever's dog 67 is engaged with the rotatable gear, rotation of the handle grip rotates both the rotatable gear and the control lever. In use, a coarse adjustment of the trowel blade pitch is made by controllably pivoting the control lever, after which a fine adjustment is made by controllably rotating the handle grip.

Figure 8:
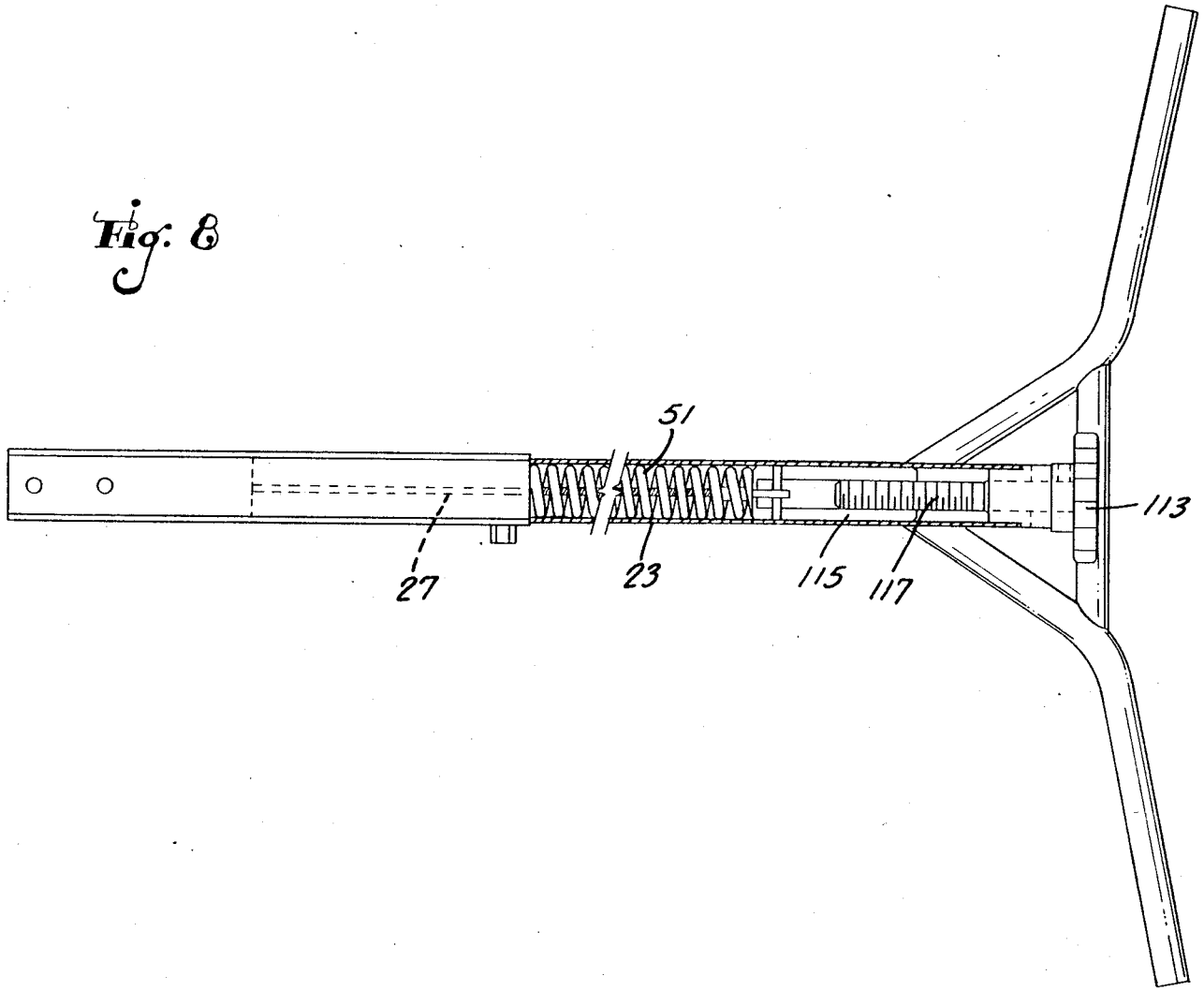
FIG. 8 is a top plan view of the handle portion of an alternative embodiment in which the control lever is replaced by a high-pitch screw handle.

FIG. 8 depicts yet another embodiment of a counterbalancing mechanism of the invention. In this embodiment, the control lever 25 of the earlier embodiments is replaced by a rotatable screw handle 113 located at the upper end of the tubular machine handle 23. A slide block 115 located within the machine handle is connected by a screw 117 to the screw handle, such that rotation of the screw handle moves the slide block axially within the tube. The tension cable 27 is connected to and pulls downwardly on the slide block, and the compressed coil spring 51 counterbalances this pull by bearing against and pushing upwardly on the slide block. This counterbalancing force permits the screw 117 to have a very large pitch, such that the entire range of movement can be traversed conveniently with just a few turns of the screw handle.

It should be appreciated from the foregoing description that the present invention provides an improved concrete finishing machine having special counterbalancing means that facilitates rapid and convenient adjustment of the pitch of the machine's trowel blades. The blade pitch is adjusted using a conveniently-located control handle such as a pivotable lever that is connected to the blades by a tension cable. The couterbalancing means resists the force applied by the cable to the handle, such that an operator can adjust the handle's position with minimal force.

Although the invention has been described in detail with reference only to the presently-preferred embodiments, it will be appreciated that those skilled in the art can make various modifications to the disclosed embodiments without departing from the invention. Accordingly, the invention is defined only by the following claims.

I claim:

1. A concrete finishing machine comprising:

a rotatable trowel blade assembly having a pluraity of substantially planar trowel blades in circumferentially-spaced arrangement, wherein the blades are adapted to rest on a concrete surface and support substantially the entire weight of the machine;

an elongated, tubular machine handle; and adjustment means for controllably pivoting the trowel blades about their respective radial axes, to adjust their pitch relative to the concrete surface on which the blades rest and thereby raise or lower the machine on the surface correspondingly, the adjustment means including control means including a control handle, means interconnecting the control means and the trowel blade assembly, wherein positioning of the control handle effects a corresponding pivotal positioning of the trowel blades, and counterbalancing means located within the tubular machine handle and operatively connected to the control handle, for applying a counterbalancing force to the control handle comparable to the force applied to the control handle by the interconnecting means, whereby the control handle can be controllably positioned with substantially less force than otherwise would be required, wherein the control means is configured such that the control handle and trowel blade pitch remain fixed except when the control handle is selectively repositioned.

2. A concrete finishing machine as defined in claim 1, wherein the counterbalancing means includes a coil spring located within the tubular machine handle.

3. A concrete finishing machine as defined in claim 2, wherein:

the coil spring is compressed;

the interconnecting means includes a tension cable; and the tension cable and the coil spring are coaxially arranged.

4. A concrete finishing machine as defined in claim 2, wherein:

the control handle is located near the remote end of the tubular machine handle; and the coil spring is located axially within the tubular machine handle.

5. A concrete finishing machine as defined in claim 4, wherein:

the control means includes a rotatable screw located at the remote end of the tubular machine handle, and a slide block located within the tubular machine handle and threadedly engaged with the rotatable screw such that rotation of the screw slides the slide block axially within the machine handle; and the coil spring and interconnecting means are operatively connected to the slide block.

6. A concrete finishing machine as defined in claim 1, wherein:

the control means includes a lever pivotally attached at a pivot point to the machine handle, one end of the lever being manually engagable by an operator of the machine;

the interconnecting means is connected to a portion of the lever spaced from the manually-engagable end; and the counterbalancing means engages a portion of the lever spaced from the manually-engagable end.

7. A concrete finishing machine as defined in claim 6, wherein the control means further includes a gear mounted on the machine handle and a dog mounted on the lever and selectively engageable with the gear to secure the lever in a selected pivotal position.

8. A concrete finishing machine as defined in claim 1, wherein said counterbalancing means includes means for controllably adjusting the amount by which it forcibly resists the force applied to the control handle by the interconnecting means.

9. A concrete finishing machine as defined in claim 8, wherein:

the counterbalancing means includes a compressed spring; and the means for controllably adjusting includes means for adjusting the amount by which the spring is nominally compressed.

10. A concrete finishing machine comprising:

a rotatable hub:

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated, tubular machine handle for use in guiding and controlling the machine on the concrete surface;

a manually-movable control handle mounted on the machine handle;

a tension cable interconnecting the control handle with the blade pivoting means such that movement of the control handle effects a corresponding pivoting of the trowel blades; and counterbalancing means located within the tubular machine handle and operatively connected to the control handle, for applying a counterbalancing force to the control handle comparable to the force applied to the control handle by the tension cable, whereby the control handle can be controllably positioned with substantially less force than otherwise would be required;

wherein the control handle is configured such that it and the trowel blade pitch remain fixed except when the control handle is manually repositioned.

11. A concrete finishing machine as defined in claim 10, wherein:

the counterbalancing means includes a compressed coil spring; and the tension cable and the coil spring are coaxially arranged within the tubular machine handle.

12. A concrete finishing machine as defined in claim 10, wherein the counterbalancing means includes:

a compressed coil spring; and means for controllably adjusting the amount by which the coil spring is nominally compressed, to correspondingly adjust the amount by which the coil spring resists the force applied to the control handle by the tension cable.

13. A concrete finishing machine as defined in claim 10, wherein the manually-movable control handle includes a lever pivotally attached at a pivot point to the machine handle, one end of the lever being manually engagable by an operator of the machine;

the tension cable is connected to a portion of the lever spaced from the manually-engagable end; and the counterbalancing means engages a portion of the lever spaced from the manually-engagable end.

14. A concrete finishing machine as defined in claim 13, wherein the control hanle further includes a gear mounted on the machine handle and a dog mounted on the lever and selectively engagable with the gear to secure the lever in a selected pivotal position.

15. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated tubular machine handle for use in guiding and controlling the machine on the concrete surface;

a manually-movable control lever pivotally attached to the machine handle, one end of the lever being manually engagable by an operator of the machine;

a tension cable extending through the tubular machine handle and interconnecting a portion of the control lever spaced from the manually-engagable end with the blade pivoting means, such that pivoting of the control lever effects a corresponding pivoting of the trowel blades;

a gear mounted on the machine handle;

a dog mounted on the control lever and selectively engagable with the gear to secure the lever in a selected pivotal position;

means for controllably rotating the gear relative to the machine handle, such that when the dog selectively engages the gear, rotation of the gear effects a corresponding pivoting of the lever and adjustment of the trowel blade pitch;

a compressed coil spring carried within the tubular machine handle and operatively connected to a portion of the control lever spaced from the manually engagable end, for forcibly resisting a substantial proportion of the force applied to the control handle by the tension cable, whereby the control lever can be controllably positioned with substantially less force than otherwise would be required; and means for controllably adjusting the amount by which the coil spring is nominally compressed, to correspondingly adjust the amount by which the coil spring resists the force applied to the control lever by the tension cable.

16. A concrete finishing machine as defined in claim 15, wherein the means for controllably adjusting includes a slide block located at one end of the compressed spring and movable relative to the machine handle to change the amount by which the spring is nominally compressed;

a rack gear secured to the slide block and oriented with its axis aligned with the direction of movement of the slide block; and a pinion gear rotatably mounted on the machine handle and engaged with the rack gear, rotation of the pinion gear moving the rack gear and slide block so as to change the amount by which the spring is nominally compressed.

17. A concrete finishing machine as defined in claim 15, wherein:

the means for controllably adjusting includes a slide block located at one end of the compressed spring and movable to change the amount by which the spring is nominally compressed, a lead screw rotatably mounted on the machine handle with its axis aligned with the direction of movement of the slide block, and a follower secured to the slide block and threadedly engaged with the lead screw; and rotation of the lead screw moves the follower and slide block so as to change the amount by which the spring is nominally compressed.

18. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the surface to be finished;

blade pivoting means engageable with the plurality of trowel blades for pivoting the blades about their respective radial axes, to adjust the pitch of the individual blades relative to the concrete surface and thereby raise or lower the machine on the surface correspondingly;

an elongated tubular machine handle for use in guiding and controlling the machine on the concrete surface;

a manually-movable control lever pivotally mounted on the machine handle and having a manually-engagable end;

a tension cable located within the tubular machine handle and interconnecting the control lever with the blade pivoting means, such that pivoting movement of the control lever effects a corresponding pivoting of the trowel blades;

a tubular housing carried by the machine handle, with its longitudinal axis arranged substantially parallel with the longitudinal axis of the machine handle;

a compressed coil spring located within the tubular housing and operatively connected to the control lever, for applying a counterbalancing force to the control lever comparable to the force applied to the control lever by the tension cable, whereby the control lever can be controllably positioned with substantially less force than otherwise would be required; and means for selectively locking the control lever in a selected position, such that the trowel blade pitch remains fixed.

19. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated tubular machine handle for use in guiding and controlling the machine on the concrete surface;

a manually-movable control lever pivotally attached to the machine handle, one end of the lever being manually engagable by an operator of the machine;

a tension cable extending through the tubular machine handle and interconnecting a portion of the control lever spaced from the manually-engagable end with the blade pivoting means, such that pivoting of the control lever effects a corresponding pivoting of the trowel blades;

a compressed coil spring carried within the tubular handle and operatively connected to a portion of the control lever spaced from the manually engagable end, for forcibly resisting substantially the entire force applied to the control handle by the tension cable, whereby the control handle can be controllably positioned with substantially less force than otherwise would be required;

means for controllably adjusting the amount by which the coil spring is nominally compressed, to correspondingly adjust the amount by which the coil spring resists the force applied to the control lever by the tension cable; and means for locking the control lever in a selected position, such that the trowel blade pitch remains fixed.

20. A concrete finishing machine comprising:

a rotatable trowel blade assembly having a plurality of substantially planar trowel blades in cirumferentially-spaced arrangement, wherein the blades are adapted to rest on a concrete surface and support substantially the entire weight of the machine;

an elongated machine handle; and adjustment means for controllably pivoting the trowel blades about their respective radial axes, to adjust their pitch relative to the concrete surface on which the blades rest and thereby raise or lower the machine on the surface correspondingly, the adjustment means including control means including a control lever pivotally attached at a pivot point to the machine handle, one end of the lever being manually engagable by an operator of the machine, means interconnecting the trowel blade assembly and a portion of the control lever spaced from the manually-engagable end, wherein positioning of the control lever effects a correspondingly pivotal positioning of the trowel blades, and counterbalancing means operatively connected to a portion of the control lever spaced from the manually-engagable end, for forcibly resisting the force applied to the control lever by the interconnecting means, whereby the control lever can be controllably positioned with substantially less force than otherwise would be required;

wherein the control means further includes a gear mounted on the machine handle and a dog mounted on the lever and selectively engagable with the gear to secure the lever in a selected pivotal position, and means for controllably rotating the gear relative to the machine handle, such that when the dog selectively engages the gear, rotation of the gear effects corresponding pivoting of the lever and adjustment of the trowel blade pitch.

21. A concrete finishing machine comprising:

a rotatable trowel blade assembly having a plurality of substantially planar trowel blades in circumferentially-spaced arrangement, wherein the blades are adapted to rest on a concrete surface and support substantially the entire weight of the machine;

an elongated machine handle; and adjustment means for controllably pivoting the trowel blades about their respective radial axes, to adjust their pitch relative to the concrete surface on which the blades rest and thereby raise or lower the machine on the surface correspondingly, the adjustment means including control means including a control handle, means interconnecting the control handle and the trowel blade assembly wherein positioning of the control handle effects a corresponding pivotal positioning of the trowel blades, a compressed spring operatively connected to the control handle, for forcibly resisting the force applied to the control handle by the interconnecting means, whereby the control handle can be controllably positioned with substantially less force than otherwise would be required, a slide block located at one end of the compressed spring and movable relative to the machine handle to change the amount by which the spring is nominally compressed, a rack gear secured to the slide block and oriented with its axis aligned with the direction of movement of the slide block, and a pinion gear rotatably mounted on the machine handle and engaged with the rack gear, rotation of the pinion gear moving the rack gear and slide block so as to change the amount by which the spring is nominally compressed.

22. A concrete finishing machine comprising:

a rotatable trowel blade assembly having a plurality of substantially planar trowel blades in circumferentially-spaced arrangement, wherein the blades are adapted to rest on a concrete surface and support substantially the entire weight of the machine;

an elongated machine handle; and adjustment means for controllably pivoting the trowel blades about their respective axes, to adjust their pitch relative to the concrete surface on which the blades rest and thereby raise or lower the machine on the surface correspondingly, the adjustment means including control means including a control handle, means interconnecting the control handle and the trowel blade assembly, wherein positioning of the control handle effects a corresponding pivotal positioning of the trowel blades, a compressed spring operatively connected to the control handle, for forcibly resisting the force applied to the control handle by the interconnecting means, whereby the control handle can be controllably positioned with substantially less force than otherwise would be required, a slide block located at one end of the compressed spring and movable to change the amount by which the spring is nominally compressed, a lead screw rotatably mounted on the machine handle with its axis aligned with the direction of movement of the slide block, and a follower secured to the slide block and threadedly engaged with the lead screw, wherein rotation of the lead screw moves the follower and slide block so as to change the amount by which the spring is nominally compressed.

23. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated machine handle for use in guiding and controlling the machine on the concrete surface;

a manually-movable control handle including a lever pivotally attached at a pivot point to the machine handle, one end of the lever being manually engagable by an operator of the machine;

a tension cable interconnecting the blade pivoting means with a portion of the control handle lever spaced from the manually-engagable end, such that movement of the control handle lever effects a corresponding pivoting of the trowel blades;

wherein the control handle further includes a gear mounted on the machine handle and a dog mounted on the lever and selectively engagable with the gear to secure the lever in a selected pivotal position, and means for controllably rotating the gear relative to the machine handle, such that when the dog selectively engages the gear, rotation of the gear effects a corresponding pivoting of the lever and adjustment of the trowel blade pitch; and counterbalancing means carried by the machine handle and operatively connected to a portion of the control handle lever spaced from the manually-engagable end, for forcibly resisting a substantially proportion of the force applied to the control handle by the tension cable, whereby the control handle can be controllably positioned with substantially less force than otherwise would be required.

24. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated machine handle for use in guiding and controlling the machine on the concrete surface;

a manually-movable control handle mounted on the machine handle;

a tension cable interconnecting the control handle with the blade pivoting means such that movement of the control handle effects a corresponding pivoting of the trowel blades;

a compressed coil spring carried by the machine handle and operatively connected to the control handle, for forcibly resisting a substantial proportion of the force applied to the control handle by the tension cable, whereby the control handle can be controllably positioned with substantially less force than other wise would be required;

a slide block located at one end of the compressed spring and movable relative to the machine handle to change the amount by which the spring is nominally compressed;

a rack gear secured to the slide block and oriented with its axis aligned with the direction of movement of the slide block; and a pinion gear rotatably mounted on the machine handle and engaged with the rack gear, rotation of the pinion gear moving the rack gear and slide block so as to change the amount by which the spring is nominally compressed.

25. A concrete finishing machine comprising:

a rotatable hub;

a plurality of uniformly-spaced, substantially planar trowel blades projecting radially outwardly from the rotatable hub, wherein the blades are adapted to rest on a concrete surface to be finished and support substantially the entire weight of the machine;

means for rotating the hub and plurality of trowel blades at a predetermined angular velocity such that the blades rotatably slide on the concrete surface to be finished;

blade pivoting means engagable with the plurality of trowel blades for pivoting the blades about their respective radial axes, to adjust the pitch of the individual blades relative to the concrete surface and thereby raise or lower the machine on the surface correspondingly;

an elongated machine handle for use in guiding and controlling the machine on the concrete surface;

a manually-movable control handle mounted on the machine handle;

a tension cable interconnecting the control handle with the blade pivoting means such that movement of the control handle effects a corresponding pivoting of the trowel blades;

a compressed coil spring carried by the machine handle and operatively connected to the control handle, for forcibly resisting a substantial proportion of the force applied to the control handle by the tension cable, whereby the control handle can be controllably positioned with substantially less force than otherwise would be required;

a slide block located at one end of the compressed spring and movable to change the amount by which the spring is nominally compressed;

a lead screw rotatably mounted on the machine handle with its axis aligned with the direction of movement of the slide block; and a follower secured to the slide block and threadedly engaged with the lead screw, wherein rotation of the lead screw moves the follower and slide block so as to change the amount by which the spring is nominally compressed.

* * * * *